US007124922B2

(12) United States Patent
Marks

(10) Patent No.: US 7,124,922 B2
(45) Date of Patent: Oct. 24, 2006

(54) STAPLER SAFETY GUARD

(75) Inventor: Joel S. Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 0 days.

(21) Appl. No.: 11/064,493

(22) Filed: Feb. 23, 2005

(65) Prior Publication Data

US 2006/0186169 A1 Aug. 24, 2006

(51) Int. Cl.
*B25C 1/04* (2006.01)

(52) U.S. Cl. ..... 227/8; 227/120; 227/129; 227/132

(58) Field of Classification Search ..... 227/120, 227/129, 132, 8, 108, 121, 125, 126
See application file for complete search history.

(56) References Cited

U.S. PATENT DOCUMENTS

| | | | | |
|---|---|---|---|---|
| 1,956,174 | A | 4/1934 | Maynard | |
| 2,142,782 | A | 1/1939 | Gillette | |
| 2,218,794 | A | 10/1940 | Kilbride | |
| 2,271,479 | A | 1/1942 | Gambao | |
| 2,421,429 | A | 6/1947 | Obstfeld | |
| 2,657,384 | A | 11/1953 | Boroughs | |
| 2,726,391 | A | 12/1955 | Pilblad | |
| 2,733,440 | A | 2/1956 | Jenny | |
| 2,884,636 | A | 5/1959 | Abrams | |
| D186,342 | S | 10/1959 | Marano | |
| 2,915,753 | A | 12/1959 | Ruskin | |
| 3,034,128 | A | 5/1962 | Robbins | |
| 3,630,428 | A | 12/1971 | Olney et al. | |
| 3,758,016 | A | 9/1973 | Olney et al. | |
| 3,834,602 | A * | 9/1974 | Obergfell | 227/120 |
| 3,905,535 | A * | 9/1975 | Novak et al. | 227/120 |
| D243,148 | S | 1/1977 | Levin | |
| 4,156,499 | A | 5/1979 | Frank | |
| 4,206,863 | A | 6/1980 | Savino | |
| 4,463,890 | A | 8/1984 | Ruskin | |
| 4,546,909 | A | 10/1985 | Ebihara | |
| 4,598,852 | A | 7/1986 | Olesen | |
| 4,666,075 | A | 5/1987 | Olesen | |
| 4,795,073 | A | 1/1989 | Yamamoto et al. | |
| 4,811,884 | A | 3/1989 | Sato | |
| 5,004,142 | A | 4/1991 | Olesen | |
| 5,356,063 | A | 10/1994 | Perez | |
| 5,470,006 | A * | 11/1995 | Rodak | 227/176.1 |

(Continued)

FOREIGN PATENT DOCUMENTS

| | | |
|---|---|---|
| DE | 28 56 621 | 7/1980 |

(Continued)

*Primary Examiner*—Sameh H. Tawfik
*Assistant Examiner*—Brian Nash
(74) *Attorney, Agent, or Firm*—Paul Y. Feng; Fulwider Patton LLP

(57) ABSTRACT

A stapler or like self-powered tool for dispensing and driving fasteners includes a safety mechanism to prevent unintended ejection of a staple or fastener. A movable hook normally obstructs the path of a staple so that the staple is intercepted and stopped as a spring-biased striker ejects the staple from the stapler. The striker preferably includes a notch and an end of the hook extends into the notch so that the safety mechanism can be compact. A button bar is linked to the hook and the button bar normally extends out from the stapler. When the stapler is placed against a working surface, the working surface presses the button bar vertically into the stapler, which causes the hook to rotate out from the striker slot and enables normal stapling operation.

18 Claims, 3 Drawing Sheets

U.S. PATENT DOCUMENTS 5,470,009 A * 11/1995 Rodak ..... 227/176.1
5,476,206 A * 12/1995 Green et al. ..... 227/176.1
5,699,949 A 12/1997 Marks
5,715,982 A 2/1998 Adachi
5,816,470 A 10/1998 Plato et al.
5,836,501 A * 11/1998 Lai ..... 227/8
D413,239 S 8/1999 Lovegrove et al.
5,931,364 A 8/1999 Dennis
5,979,736 A 11/1999 Edeholt
5,988,478 A 11/1999 Marks
6,123,241 A * 9/2000 Walter et al. ..... 227/8
6,145,728 A 11/2000 Marks
6,152,347 A 11/2000 Wilson et al.
D437,754 S 2/2001 Jacquet
6,918,525 B1 * 7/2005 Marks ..... 227/120
7,032,794 B1 * 4/2006 Hung et al. ..... 227/8
2004/0232192 A1 11/2004 Marks
2005/0023319 A1 * 2/2005 Huang ..... 227/8
2005/0127129 A1 * 6/2005 Marks ..... 227/134
2005/0139631 A1 * 6/2005 Marks ..... 227/134
2005/0139634 A1 * 6/2005 Schwemberger et al. 227/180.1
2005/0169703 A1 * 8/2005 Fatemi ..... 403/321

FOREIGN PATENT DOCUMENTS

DE 19712849 A1 10/1998
DE 10138447 A1 7/2003
DE 10225816 A1 1/2004
GB 2 032 327 A 5/1980
GB 2 229 129 A 9/1990

* cited by examiner

STAPLER SAFETY GUARD

FIELD OF THE INVENTION

The present invention relates to spring-actuated staplers and similar self-powered tools for dispensing and driving fasteners. More precisely, the present invention relates to a safety mechanism for such staplers or tools.

BACKGROUND OF THE INVENTION

Staplers and related stapling devices eject staples out from a loading track into a work piece. Staplers are commonly known in two general forms or applications. A staple gun inserts a staple substantially unchanged into a work piece such as wood. A desktop stapler presses a staple against an anvil whereby the staple legs are bent behind sheets of paper. In either type of design, it is possible to eject a staple unintentionally toward a user by pointing the staple ejection port, for example, toward the face. Some staplers and most staple guns use energy stored in a spring to eject the staple. With spring-powered staplers being so common, such an injury to the user is possible.

Another type of stapler uses an electric, air, combustion, or other non-manual power source. Safety interlocks are well known in such powered applications. Typically a safety button near the staple ejection area must be pressed to enable a power circuit to be energized. In effect the trigger can switch the power device only when the tool is pressed against a work piece. U.S. Pat. No. 5,715,982 (Adachi) is an example of a protruding safety button used to lock out a trigger action in a power tool.

A similar type safety mechanism has not been effectively implemented in a manual stapler. This is likely because it is simple to disable a power circuit. For example, a microswitch may be linked to the safety button whereby the switch remains open until the button is pressed. This operation requires little force and allows for a relatively low strength plastic button assembly that is easily pressed inward to enable use. However, it is more complicated to disable a manually actuated device. In the case of a spring-actuated stapler the large impact forces make a disabling system especially difficult. One reason is that the stored potential energy of the spring is difficult to de-energize or redirect without using complicated or bulky latches, blocks, stops, etc. Also, a catch or safety that blocks the spring action must be rather bulky to absorb the high impact energy from the spring.

Moreover, a staple or other fastener may be ejected from a fastening device under different conditions. If a work piece is present, the energy of the staple is absorbed as the staple penetrates or bends about the material. If no work piece is present the staple is "dry fired." Most of the energy of the moving striker is dissipated by an internal absorber inside the conventional stapler. With a lightweight work piece the stapling energy is absorbed partly by the work piece and partly by the absorber.

The case of a dry fire is a concern of the present invention, where there is no work piece to stop the staple. Although most of the stapling energy is dissipated in the absorber, the staple will continue to shoot out under its own momentum. These and other issues are addressed by the present invention.

SUMMARY OF THE INVENTION

There are several approaches to disable a manual stapler, for example. An actuating handle may be de-linked from the staple-ejecting striker by a safety device. Then pressing the handle will cause the handle to move but the striker will remain still. Only the force from a return spring will be apparent upon the handle. Another approach to disabling a manual stapler entails immobilizing the handle. A very strong safety mechanism is required to overcome intentional, applied force from a user.

Yet another approach is to intercept the staple as it is ejected. The present invention is directed to this approach. Beneficially, the safety mechanism can be confined to just the region of the staple exit area; there is no need for added elements within the actuating mechanism. Importantly, the intercepting mechanism is not required then to absorb the full impact energy of the ejecting staple. The striker is stopped by an internal absorber in the stapler, and the intercepting mechanism stops only the momentum of the lightweight staple.

Accordingly, the present invention is directed to a safety mechanism for spring-actuated staplers or similar self-powered tools used for dispensing and driving fasteners. In one embodiment, the present invention fastening device is a spring-actuated stapler that includes a track pivotably or slidably attached to a housing to guide staples upon the track toward a striker at the front of the stapler. The striker has a raised position above the staples and is held there against spring bias. The striker has a lowered position in front of the staples, wherein the striker ejects the front-most staple outward from the stapler as the striker slides vertically from the raised position to the lowered position under spring bias.

When used with a stapler, the present invention safety mechanism preferably includes a hook normally obstructing the striker slot whereby the front-most staple is intercepted and stopped by the hook if the front-most staple is accidentally ejected from the stapler. To un-obstruct the safety hook for normal stapling, the present invention preferably includes a sensing end of a button that extends from the bottom of the housing in a normally lowered position of the button. The button is linked to the hook whereby pressing the sensing end of the button against a working surface moves it upward into the stapler. This causes the hook to pivot to a retracted position of the hook, and the striker slot is un-obstructed by the hook in its retracted position. The energized striker is then free to slide downward and eject the front-most staple by impact force.

DETAILED DESCRIPTION OF THE PREFERRED EMBODIMENTS

The present invention in various exemplary embodiments is directed to a safety mechanism useful in spring-actuated or similar self-powered type tools used in dispensing and driving fasteners. Examples include air powered industrial staplers, spring-actuated desktop staplers, spring powered staple guns, nail guns, and the like. The present invention safety mechanisms are intended to block, stop, intercept or otherwise prevent a staple or like fastener from unintentionally or accidentally being ejected at the user.

Figure 1:
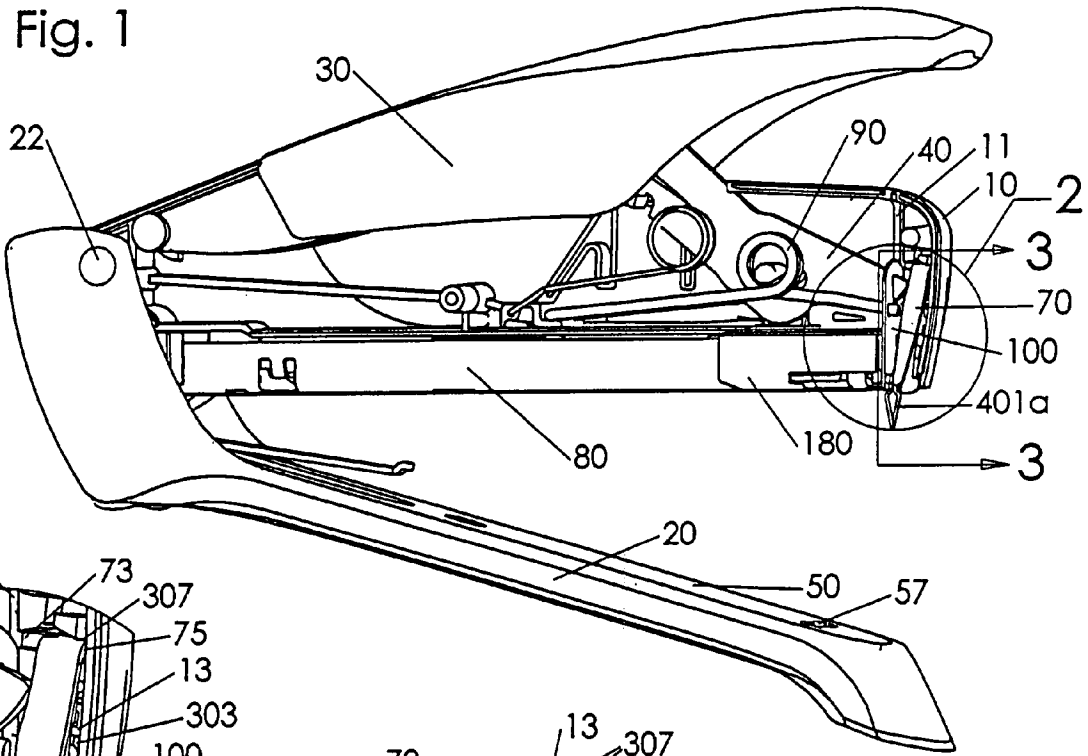
FIG. 1 is a side elevational view, partly in cross-section, of a stapler according to one embodiment of the invention, with the base partly open and a staple stopped by a safety mechanism.
Figure 4:
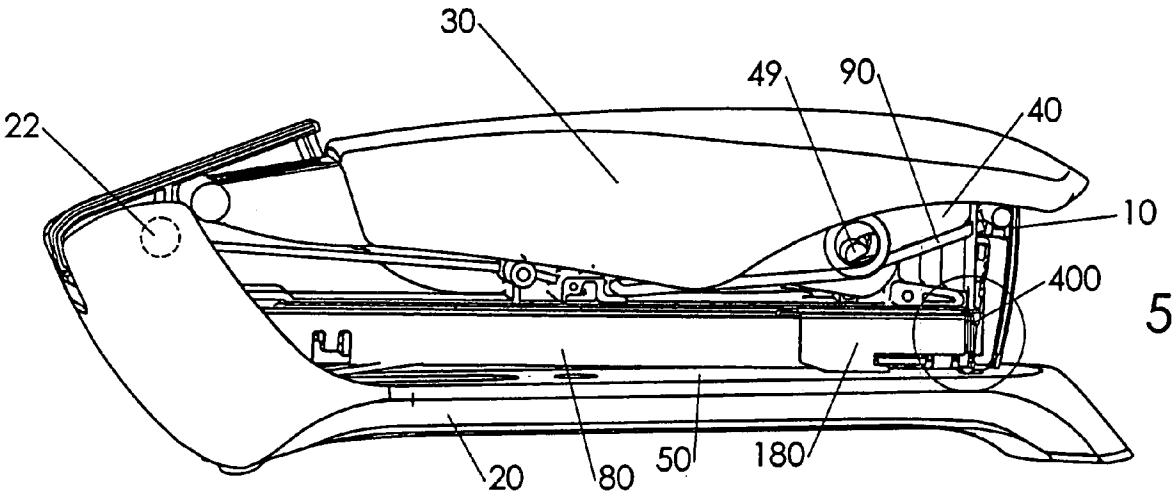
FIG. 4 is a side elevational view of the stapler of FIG. 1, with the handle lowered to a pre-release position.
Figure 5:
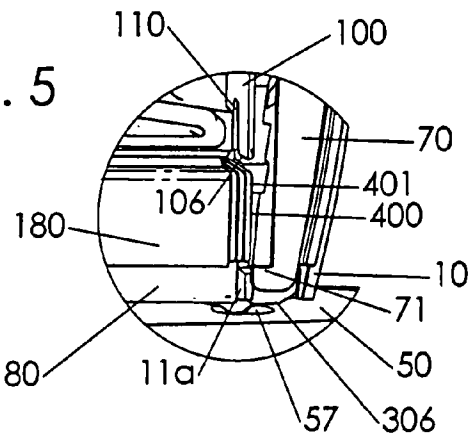
FIG. 5 is a magnified, detail view of the staple exit area of the stapler of FIG. 4.

In a preferred embodiment of the present invention, a safety mechanism presents an obstruction to a staple being ejected from a spring-actuated stapler, shown in FIG. 1. Striker 100 moves vertically within striker slot 11 including a striker "raised position" above staples 400 and front-most staple 401 in FIG. 5, and a striker "lowered position" immediately in front of front-most staple 401 in FIG. 2. In FIG. 1, handle 30 is pivotably attached to housing 10 at a rear of the housing. Pressing handle 30 causes lever 40 to rotate within housing 10. Lever 40 rises at the front and striker 100 moves upward in striker slot 11 starting in the striker lowered position shown in FIGS. 1 and 2, and moving toward the striker raised position of FIGS. 4 and 5. In the next action, lever 40 de-links from and releases striker 100. Power spring 90 then forces striker 100 toward front staple 401 to eject it out of the stapler by an impact blow. Staples 400 are guided upon track 80 toward striker 100 by urging from a spring-biased pusher 180.

It may be desired to use the stapler as a tacker to drive a staple into wood or similar material. Or it may be required to open base 20 to load staples onto track 80. In both instances then, base 20 is opened away from housing 10 as shown in FIG. 1. To do this, base 20 pivots about hinge post 22. If a user accidentally presses handle 30 while staples 400 are loaded and base 20 is opened, a staple may be ejected out of the stapler toward the user or another unintended direction.

Figure 3:
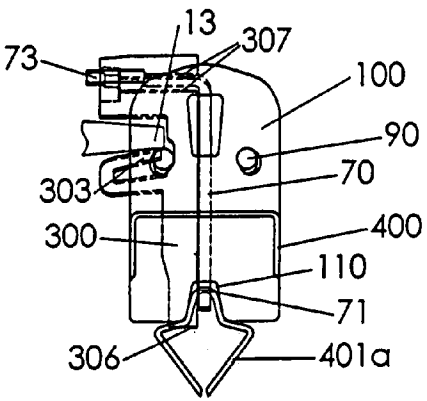
FIG. 3 is a partial sectional view taken along line 3—3 and looking from the rear of the stapler of FIG. 1, showing selected internal components at the front of the stapler.
Figure 2:
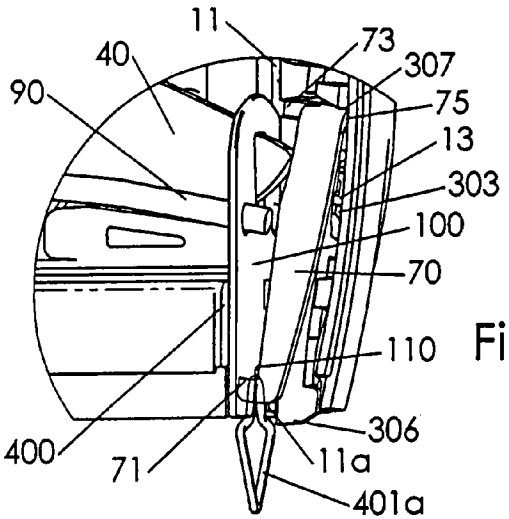
FIG. 2 is a magnified, detail view of the staple exit area of the stapler of FIG. 1.
Figure 8:
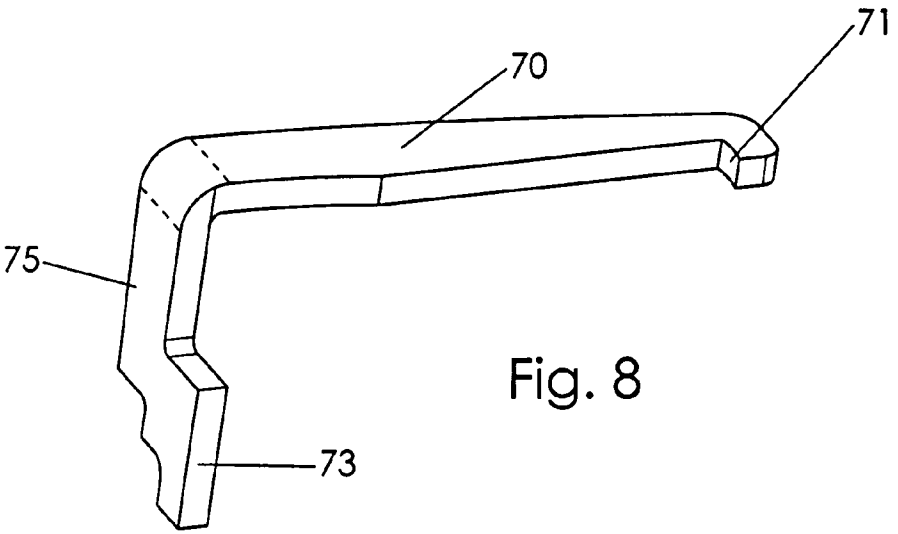
FIG. 8 is a perspective view of a safety hook.
Figure 9:
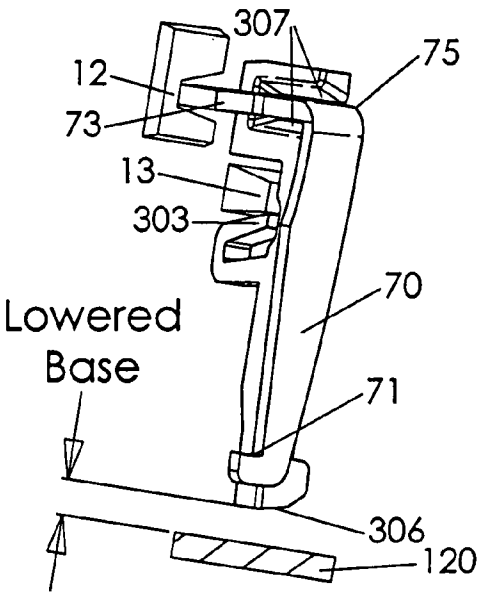
FIG. 9 is a perspective view of the safety elements of FIG. 6, with the stapler spaced from a pressing surface such as a base.

To avoid the foregoing circumstances, according to one embodiment of the present invention, a safety hook 70, normally obstructs striker slot 11 at hook end 71, as seen in FIGS. 2, 3, and 9. As best seen in FIG. 8, hook 70 preferably has an L shape with a small hook at one end 71 and a large surface area pivot end 73 extending from a flat pivot edge 75. When assembled inside the stapler, hook end 71 is oriented so that it is near the bottom of the stapler by the slot exit 11*a*. Hook 70 is illustrated in a rear position in the normally obstructing or blocking hook position in FIG. 2. If a staple is ejected out of slot exit 11*a* when base 20 or other surface is not being pressed, hook end 71 intercepts the striker-driven staple and brings it to a stop. The hook 70 is preferably made from hardened steel to endure the impact from the steel wire staples.

As best seen in FIG. 3, stopped staple 401*a* is shown after it has been intercepted or blocked from its ejection path by hook 70. The shape of stopped staple 401*a* is distorted by impact with hook end 71 and notch 110 of the downward moving striker 100. Through empirical testing, the stopped staple 401*a* assumes the approximate shape shown. More precisely, the sides of staple 401*a* are forced down around hook end 71 by striker 100 at each side of notch 110. Also, the center of stopped staple 401*a* deforms into notch 110 and remains at the level of hook end 71.

As staple 401*a* becomes distorted, the process of bending the wire absorbs some of the kinetic energy generated to eject the staple. In other words, if power spring 90 has provided the energy, then bending the wire body of stopped staple 401*a* absorbs some of the energy that had been stored by the power spring. Most of the energy is dissipated as the power spring impacts absorber 14. The energy remaining in the still moving staple is largely absorbed as the wire of staple 104*a* is bent. This energy absorption occurs through an extended time period as striker 100 travels downward and stopped staple 401*a* deforms and bends. The extended time period minimizes the "impulse" or the integral of the force magnitude over time transferred to the hook 70. Hence, if staple 401*a* were stopped all at once within a tiny amount of elapsed time, then the impulse would be much greater and the impact would likely damage hook 70 or other nearby structure. With a smaller impulse, however, the present invention safety mechanism has the advantages of improved durability and reliability.

Another advantage of the present invention is that the use of optional notch 110 enables hook end 71 to remain fully enclosed within housing 10. Notch 110 also allows more energy absorption between striker 100 and staple 401*a*. As staple 401*a* is bent in FIG. 3, inner walls of notch 110 slide along the staple wire to form the nearly 180° bend shown. The friction of such sliding dissipates additional energy. Hook end 71 can extend into notch 110 through the thickness of striker 100 when hook 70 is in the obstructing rearward position, shown in FIG. 2. Hook end 71 is therefore compactly nested within striker 100. Without notch 110, hook 70 would have to protrude out from underneath the stapler to fit under striker 100. Otherwise striker 100 would impact hook 70 in normal use. A mechanism would be required to retract hook 70 out of the way, for example, forward and upward to clear the way for staples 400 to exit and for base 20 to fully close against housing 10. This mechanism would thus be unduly complex. Therefore, notch 110 provides at least two functions: a structure to absorb kinetic energy, and to provide an open area to compactly fit hook end 71.

In a preferred embodiment, a mechanism is used to selectively obstruct striker slot 11. Striker slot 11 should be unobstructed when the stapler is pressed against a working surface and ready to fire. In the preferred embodiment, hook 70 is retracted to a forward hook position when hook end 71 is withdrawn to un-obstruct striker slot 11. The working surface may be, for example, coverplate 50 of base 20 if a stack of papers is being fastened. Or the working surface may be a bulletin board or wooden stud in a tacking job.

A sensor bar, pin, rod, feeler, or the like engages the working surface, and this engagement deactivates the safety hook. Specifically, the sensor is pushed into the stapler, or equivalently into housing 10, by the working surface. It is desirable that the sensor be as close as possible to the staple exit location. Then the sensor operates precisely at the location that is being stapled. This is important if an irregular surface is being stapled and the working surface includes a depression or recess near the staple exit area. The staple could be improperly blocked by hook 70 if the sensor extends into the depression even as the staple is aimed at a raised part of the working surface adjacent to the depression.

On the other hand, the sensor should not be located precisely at the staple slot exit 11*a* so that the sensor does not enter the depression formed by anvil 57, shown in FIG. 1. The depression is there, of course, to bend the staple legs behind a stack of papers to be bound together.

Figure 6:
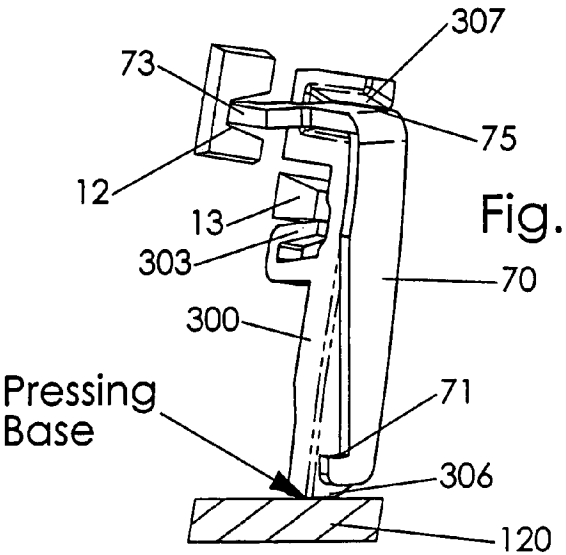
FIG. 6 is a magnified, perspective view of the safety elements of one embodiment of the invention, with the stapler pressing a base or other surface to disengage the safety mechanism.
Figure 7:
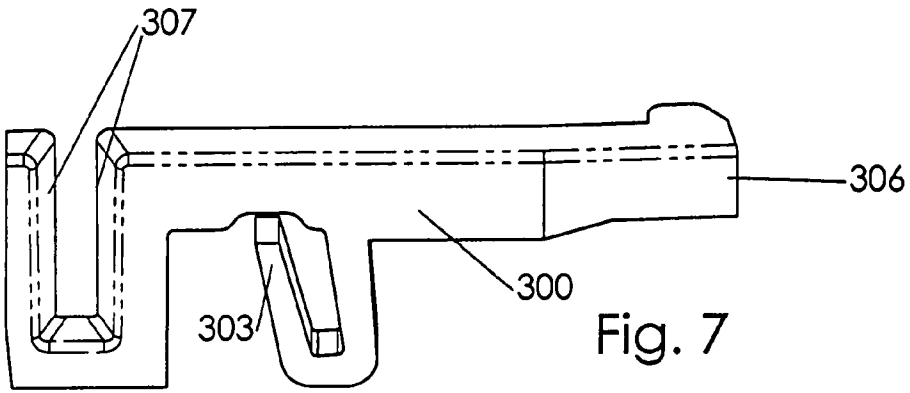
FIG. 7 is a front, side perspective view of a safety button.

To apply the foregoing concept, the illustrated embodiment of the safety mechanism preferably includes two elements: a hooking bar and a button bar, shown in FIGS. 3 and 6. Button bar 300 is a shaped preferably plastic bar that serves as the sensor and converts vertical motion into rotational motion of hook 70. As best seen in FIGS. 6 and 7, button bar 300 has an elongated bar shape with two curled, hook-like portions. More precisely, button bar 300 includes sensing end 306, hook engaging slot 307, and bias spring 303. Biasing spring 303 when formed from a semi-rigid plastic or resilient metal has a cantilever arm that has compliance thus creating the spring action. As seen in FIG. 9, biasing spring 303 biases the button bar 300, downward in the drawing, out of housing 10 toward working surface 120. It is possible to use a rubber pad mounted to housing rib 13 in place of the cantilever arm to achieve this compliance. To save cost, button bar 300 may be made from a plastic material since it does not directly interact with the energized staple. Instead, button bar 300 controls the position of hook 70.

In FIGS. 6 and 9, the interaction between button bar 300 and hook 70 is shown. Sensing end 306 extends out slightly from the bottom of the stapler as seen in FIG. 2. In FIG. 6, working surface 120 is pressed by button sensing end 306. Since working surface 120 is relatively immovable, button bar 300 is itself forced upward toward or within housing 10. Similarly, in FIG. 5, button sensing end 306 is depicted pressing against a working surface which in this instance is cover plate 50.

Hook pivot end 73 fits into immobile notch 12 formed into the interior of housing 10, as seen in FIG. 6. Hook edge 75 is an enlarged flat area of the hook 70 that is captured with slight play within slot 307 of button bar 300. Slot 307 preferably has a tapered open area so that captured hook edge 75 can flap freely up and down therein. Hook 70 is thus linked to button bar 300.

As button bar 300 is forced upward by the working surface, slot 307 moves up and forces captured hook edge 75 up with it. The very tip of hook pivot end 73 is captured within immobile notch 12 inside housing 10, and preferably adjacent to striker slot 11. In FIG. 2 this close spacing of hook pivot end 73 and striker slot 11 is visible. By positioning pivoting end 73 as near as possible to striker 100, the assembly of hook 70 and button bar 300 does not extend farther forward than necessary. The assembly therefore fits into a compact front end of the stapler. In FIG. 9 a narrow rib of notch 12 defines a left or rear position limit of the upper part of hook 70. Notch 12 also has an optional tapered open area to accommodate the pivoting movement of hook pivot end 73 therein. In this manner, hook pivot end 73 does not contact striker 100 as the striker moves vertically in slot 11. As hook 70 pivots counterclockwise at notch 12, hook end 71 moves forward, to the right in FIG. 6; also, as hook 70 rotates counterclockwise, hook edge 75 moves upward in FIG. 6.

In FIG. 9, working surface 120 is spaced away from button sensing end 306, which occurs when base 20 is pivoted to a lowered position. Sensing end 306 biased vertically downward as a result of bias spring 303 pressing against rib 13 of housing 10. See also FIG. 2. Therefore, button bar 300 is normally in the lowered position of FIG. 9, and hook end 71 is in the rear, hooked position, to the left in FIG. 9. Hook end 71 is thus in the deployed, obstructing position wherein staples cannot exit the stapler.

In the exemplary embodiments, the elements of the safety mechanism are entirely contained in the small, compact space in the front of striker 100. Hook 70 and button bar 300 are narrow elements elongated in a substantially parallel relationship to striker 100.

In an alternative embodiment (not shown), the button bar may be a straight pin that engages the working surface at its bottom end and a hooking bar at the top end. The L-shaped hooking bar has a flat hooking edge area with a hooking portion on one side of where the button bar engages the hooking edge and a pivot point at the other side, similar to that shown in FIG. 6. The pivot point in FIG. 6, namely, notch 12 and hook pivot end 73, can be replaced by using a pin to attach the hook pivot end to the housing. The pin serves as a hinge or pivot point. Thus, the vertical translation of the button bar into the hooking bar causes a rotational motion of the hooking bar to rotate the hooking bar about the pivot point. A rubber pad mounted against the housing interior pushing downward on the top of hooking bar would bias the button bar to its normal position extending out of the housing, and would likewise rotate the hooking bar clockwise in FIG. 6 to the normal, blocked staple exit position.

Alternatively, the above-described safety mechanism may be fitted to the rear of striker 100. In this case, a hook may slide horizontally within track 80 including a rear, disengaged position away from striker slot 11 and a forward position wherein the front of the hook obstructs striker slot 11. A button bar or other sensing element is linked to the horizontally movable hook so that pressing the sensing element causes the hook to move toward its rear position.

The safety mechanism of the present invention is useful in a variety of devices. Namely, it may be fitted to a desktop stapler, staple gun, power driven stapler, nailer, or the like. By employing the safety mechanism of the present invention, a compact device can prevent unintended ejection of fasteners without complex linkages to internal components of that stapler, staple gun, or the like.

From the foregoing detailed description, it should be evident that there are a number of changes, adaptations and modifications of the present invention that come within the province of those skilled in the art. However, it is intended that all such variations not departing from the spirit of the invention be considered as within the scope thereof except as limited solely by the following claims.

I claim:

1. A safety mechanism for a self-powered tool that ejects and drives fasteners into a working surface, comprising:

a housing having a striker slidable along a path therein;

a plurality of fasteners disposed within the housing along the path of the striker;

a spring biasing the striker into the fasteners;

a release lever selectively linked to the striker;

a hooking bar pivotably engaging the housing and biased into the path of the striker before the fasteners;

a sensor bar extending from the housing at a sensing end of the sensor bar and engaging the hooking bar at an engaging end of the sensor bar, wherein the sensor bar translates linearly in the housing, and the engaging end of the sensor bar selectively engages the hooking bar to generate a pivoting motion; and wherein the sensing end of the sensor bar engages the working surface which translates the engaging end of the sensor bar into the hooking bar to pivot the hooking bar against a rib of the housing and out of the path of the striker.

2. The safety mechanism of claim 1, wherein the hooking bar includes an L shape with a pivot end engaging an immobile notch formed in the housing.

3. The safety mechanism of claim 2, wherein the sensor bar includes a notch for receiving a portion of the hooking bar therein, wherein linear translation of the sensor bar moves the notch which flaps the portion of the hooking bar therein.

4. The safety mechanism of claim 1, wherein the striker includes a notch to receive a hook end of the hooking bar.

5. The safety mechanism of claim 1, wherein the sensor bar includes a resilient cantilever arm to engage the housing.

6. A stapler comprising:

a housing;

a track attached to the housing to guide staples upon the track toward a striker at a front of the stapler, the striker including a raised position above the staples and a lowered position in front of the staples, wherein the striker ejects a front-most staple outward from the stapler as the striker moves vertically from the raised position to the lowered position;

a hook normally obstructing a striker slot wherein the front-most staple is intercepted and stopped by the hook when the front-most staple is ejected from the stapler; and a sensing end of a button bar extending from a bottom of the housing in a normally lowered position of the button bar, wherein the button bar is linked to the hook, and pressing the sensing end of the button bar upward into the stapler causes the hook to move to a retracted position of the hook, and the striker slot is un-obstructed by the hook in the retracted position.

7. The stapler of claim 6, wherein the button bar moves vertically within the housing, the hook is rotatably fitted within the housing in front of the striker, so when the hook is obstructing the striker slot the hook is in a rear position, and when the hook is retracted the hook is in a forward position, and the hook rotates from the rear position to the forward position when the button bar moves upward into the stapler.

8. The stapler of claim 7, wherein the button bar includes a bias spring, and the bias spring is a resilient extension of the button bar, and the bias spring presses a rib of the housing to bias the button bar toward the lowered position of the button bar.

9. The stapler of claim 6, wherein the striker includes a notch in a bottom of the striker, and when the button bar is in the lowered position and the hook obstructs the striker slot, a hook end of the hook extends into the notch of the striker.

10. The stapler of claim 9, wherein the striker presses sides of the front most staple at the striker notch, the staple is bent around the hook end, and a center of the staple is within the striker notch.

11. The stapler of claim 9, wherein the hook includes a hook end at a lower end of the hook, and the housing of the stapler encloses the hook end.

12. The stapler of claim 6, wherein a slot of the button bar is linked to an edge of the hook, and the hook is pivotably attached to the housing at a pivot end of the hook.

13. The stapler of claim 6, wherein the pivot end of the hook is adjacent to the striker slot.

14. The stapler of claim 6, wherein the sensing end is pressed by a base of the stapler, the base being pivotably attached to the housing.

15. The stapler of claim 6, wherein the hook extends within the track, the hook slides horizontally within the track including a rear, disengaged position away from the striker slot and a forward position wherein a front of the hook obstructs striker slot.

16. The stapler of claim 6, wherein a power spring is linked to the striker, and the power spring forces the striker to eject the staple by impact blow.

17. The stapler of claim 6, wherein a power spring is linked to the striker, and the power spring forces the striker to eject the staple by impact blow, and energy from the power spring is absorbed by bending the wire of the staple.

18. A stapler comprising:

a housing;

a track attached to the housing to guide staples upon the track toward a striker at a front of the stapler, the striker including a raised position above the staples and a lowered position in front of the staples, the striker ejecting a front-most staple outward from the stapler as the striker moves vertically from the raised position to the lowered position;

a hook that normally obstructs a striker slot whereby the front most staple is intercepted and stopped by the hook when the front most staple is ejected from the stapler;

a sensing end of a button bar extending from a bottom of the housing in a normally lowered position of the button bar, the button bar is linked to the hook whereby pressing the sensing end of the button bar upward into the stapler causes the hook to move to a retracted position of the hook, the striker slot is un-obstructed by the hook in the retracted position; and wherein the striker includes a notch in a bottom of the striker, and when the hook is in the lowered position and the hook obstructs the striker slot, a hook end of the hook extends into the notch of the striker, the striker presses sides of the front most staple at the striker notch, the staple is bent around the hook end, and a center of the staple is deformed within the striker notch.

* * * * *